US006116488A

United States Patent [19]

Lee

[11] Patent Number: 6,116,488

[45] Date of Patent: Sep. 12, 2000

[54] TRIGGER SWITCHING STRUCTURE OF CONTACT/FULL SEQUENTIAL ACTUATION FASTENING TOOL

[76] Inventor: Yun-Chung Lee, No. 29, Wu-Chuan Liau Rd., Wu-Ku Industrial Park, Taipei Hsien, Taiwan

[21] Appl. No.: 09/511,602

[22] Filed: Feb. 23, 2000

[51] Int. Cl.[7] ..... B25C 1/04

[52] U.S. Cl. ..... 227/8; 227/130

[58] Field of Search ..... 227/130, 8, 120, 227/147, 131, 171

[56] References Cited

U.S. PATENT DOCUMENTS

| | | | |
|---|---|---|---|
| 5,551,621 | 9/1996 | Vallee | 227/8 |
| 5,662,257 | 9/1997 | Mukoyama et al. | 227/130 |
| 5,692,663 | 12/1997 | Yang | 227/8 |
| 5,791,545 | 8/1998 | Lin | 227/130 |
| 5,836,501 | 11/1998 | Lai | 227/8 |
| 5,862,969 | 1/1999 | Lee | 227/8 |
| 6,059,161 | 5/2000 | Chang et al. | 227/130 |

*Primary Examiner*—Scott A. Smith
*Attorney, Agent, or Firm*—Pro-Techtor International Services

[57] ABSTRACT

A trigger switching structure of a contact/full sequential actuation fastening tool, being used in a trigger pivotally mounted between a safety yoke and a trigger valve both of the fastening tool, the switching structure is comprised at least of a receiving seat, a stop piece and a spring. The receiving seat is provided therein a positioning rod and a supporting rod, the stop piece is pivotally mounted on the receiving seat by the positioning rod, and the receiving seat can be combined with the trigger with the supporting rod; the spring is mounted straddling the trigger and the receiving seat to allow a user to move the receiving seat to change the contact position of the stop piece and the safety yoke of the fastening tool to choose a contact actuation or a full sequential actuation position desired for fastening. By embedding the above members in the trigger, occupied space can be reduced, and accidental touching for fastening can be effectively eliminated, safety of use of the fastening tool can thus be increased.

4 Claims, 7 Drawing Sheets

TRIGGER SWITCHING STRUCTURE OF CONTACT/FULL SEQUENTIAL ACTUATION FASTENING TOOL

BACKGROUND OF THE INVENTION

1. Field of the Invention

The present invention is related to a switching structure embedded in a trigger of a fastening tool, and especially to such a structure capable of controlling switching to contact actuation or full sequential actuation in pursuance of requirement and custom of users, and capable of dust proofing and providing safety in preventing switching by accidentally touching the switching structure.

2. Description of the Prior Art

The fastening tool provided in the present invention is directed specifically to a pneumatic fastening tool. Most of the conventional pneumatic driving tools widely used in the markets each uses a trigger to press a trigger valve which controls a pushing rod in a cylinder driven by compressed air to make strong shot to give fasteners therein for fastening. However, notwithstanding the convenience of using such a pneumatic fastening tool, the fastening tool has a problem of being harmful to people by accidentally touching the trigger. Therefore, most of the fastening tools in the markets are provided with safety devices to limit activating of triggers. And the triggers are distinguished by whether they are provided with safety yokes. Those provided with safety yokes are those each with a safety yoke assembled in the fastener outlet of a fastening tool. A user can only make a triggering after he closely abuts the outlet against a surface of a work piece and presses the safety yoke. Therefore, safety in fastening can be improved. Sequence of such triggers in operation is divided generally into the following two kinds:

The first one is the full sequential trigger, the outlet for shooting shall be closely abutted against a surface of a work piece and the safety yoke can then be pressed for shooting a fastener. Thereafter, both the safety yoke and the trigger have to be returned to the starting position before the tool can be actuated. If the user presses the trigger before pressing the safety yoke, no fastener can be shot. Hence when the user has to change the working area, he must raise the fastening tool and then press the safety yoke again, then the trigger can be activated to shoot a fastener. This is the mode popularly accepted in countries accustomed to the U.S.A system.

The second one is the contact actuation trigger; the trigger can be activated to shoot a fastener whenever the safety yoke and the trigger are both pressed regardless of whether the safety yoke or the trigger is first pressed. Thereby, the user needs only to steadily press the trigger, the safety yoke can be repeatedly pressed, and thus fasteners can be serially shot; or the safety yoke can be steadily pressed, the trigger can be repeatedly pressed to have fasteners shot serially. Hence convenience of operation is increased, this is the mode popularly accepted in European countries.

However, users of fastening tools widely distributed in the world have their customs of use that are very different. Manufacturers are very hard to estimate the yield of production of fastening tools. Therefore, cost of developing, production and storage of fastening tools is very high and makes an extremely large trouble in the art. And the switching structures disclosed in the prior arts all present protrusions on the external surfaces of the fastening tools, conventional mechanisms for contact actuation are more subjected to contamination of dust and dirt, and they are more likely to make hurt of hands when in use; and more, they are more possible to induce wrong switching by accidentally touching the switching structure. Study and development of the present invention aim at solving the above stated undesired problems, and the inventor of the present invention provides the trigger switching structure of a contact actuation or full sequential actuation fastening tools based on his specific experience of years in design, study and development of pneumatic driving tools.

SUMMARY OF THE INVENTION

The main object of the present invention is to provide the trigger switching structure of a contact actuation or full sequential actuation fastening tool. Wherein, the switching structure is embedded in the trigger under the premises that the fastening tools has to have the ability of changing over between the modes of contact actuation or full sequential actuation, this can reduce occupied space, and can effectively get rid of the possibility of accidental touching. Thereby, safety of use can be obtained.

To this object, the switching structure of the present invention is practically assembled in the housing of the trigger between the safety yoke and the trigger valve; and the switching structure is comprised at least of a receiving seat, a stop piece and a spring.

Wherein, the stop piece is pivotally mounted on the receiving seat, and is arranged between the safety yoke of the fastening tool and the axle of the trigger valve. The spring is mounted straddling the trigger and the receiving seat to allow the receiving seat mounted in the housing of the trigger to have the stop piece synchronically switched and moved; so that a user can switch the switching structure by himself to change the mode of shooting of the fastening tool, i.e., to change to the contact actuation or full sequential actuation mode.

The members in the above stated switching structure can all be hidden in the trigger, thereby danger of unexpected harming by wrong switching of the switching structure can be eliminated, and possibility of hurting hands and accumulating dust and dirt can be gotten rid of by hiding the protrusions of these members. These meet the requirement of improvement of the art.

The present invention will be apparent after reading the detailed description of the preferred embodiment thereof in reference to the accompanying drawings.

DETAILED DESCRIPTION OF THE PREFERRED EMBODIMENT

Figure 1:
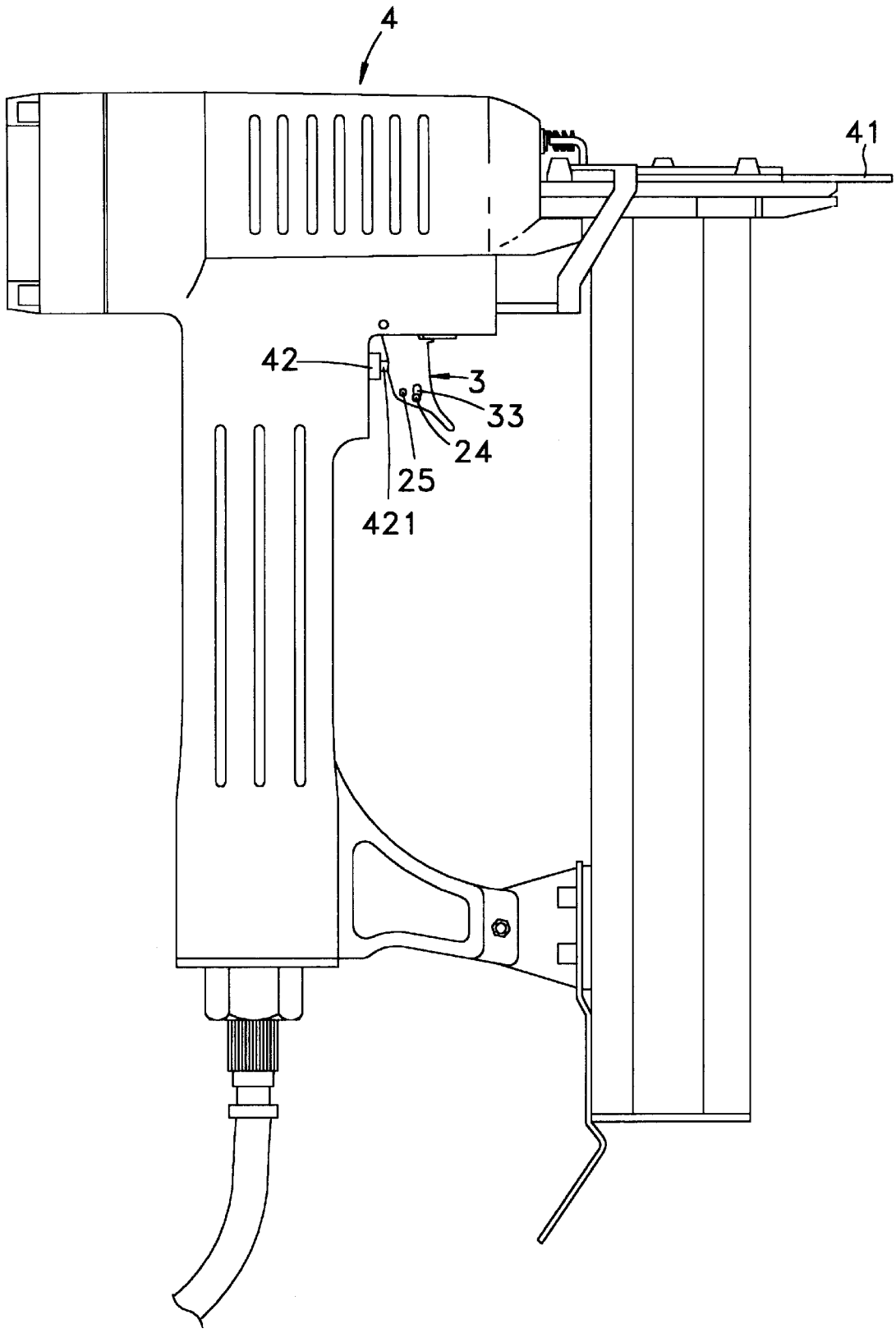
FIG. 1 is a schematic view showing allocation of the members of the present invention.

Referring to FIG. 1, a full sequential actuation fastening mode of the fastening tools 4 is cited to explain the member allocation of the switching structure of the present invention. Wherein, the present invention is resided in a trigger 3 provided between a safety yoke 41 and a trigger valve 42, and being provided at least with a receiving seat 2, a stop piece 1 and a spring 39 (as shown in FIG. 2).

Figure 3:
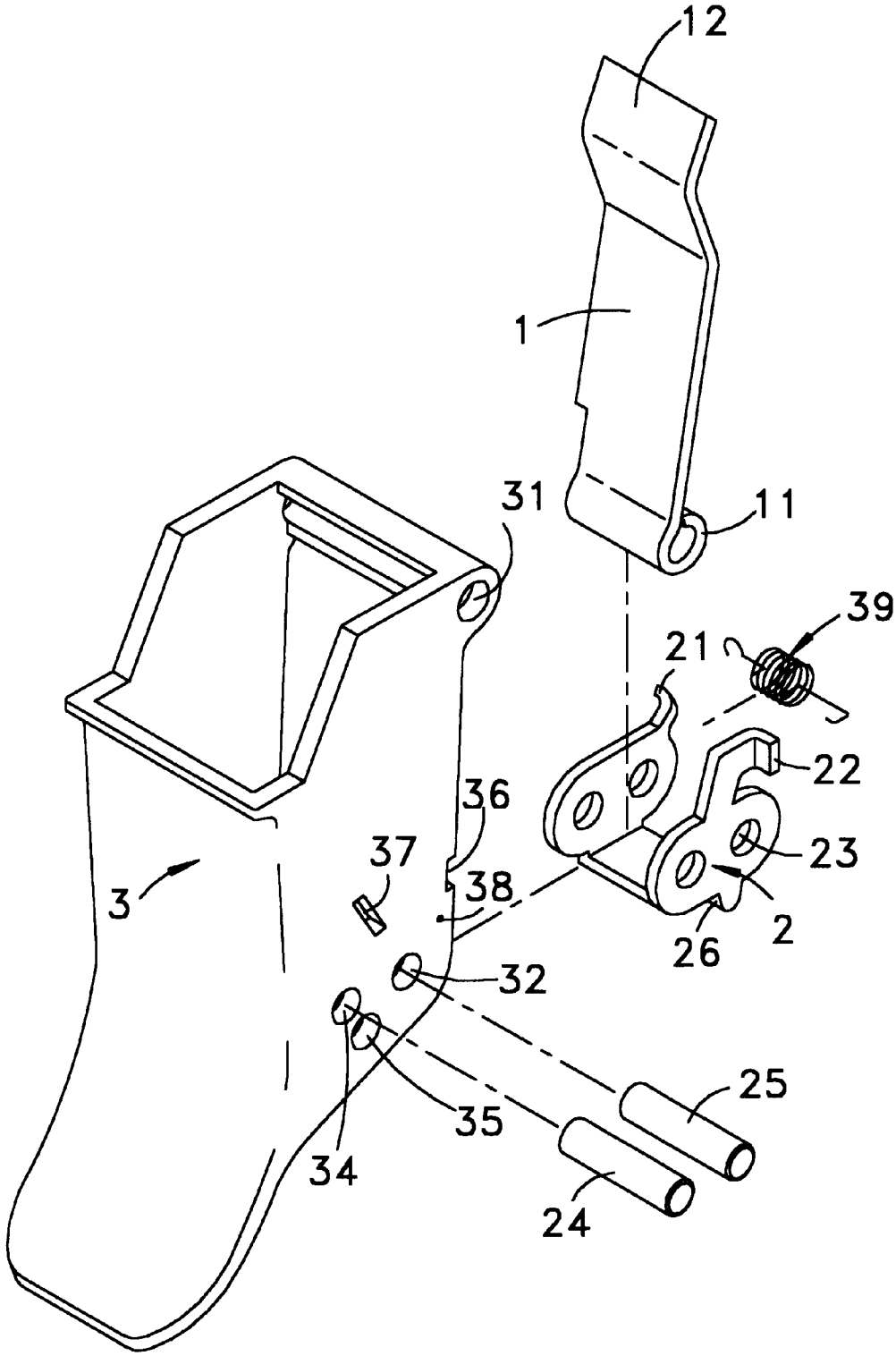
FIG. 3 is an analytic perspective view of the present invention.

The stop piece 1 has a pivot end 11 (referring to FIG. 3), and the other end thereof is bent to form a beveled stop end 12. The pivot end 11 can be inserted therethrough with a positioning rod 24; thereby, the stop piece 1 can sway on the positioning rod 24.

The receiving seat 2 is in the shape of "U" (referring to FIG. 3), the bottom thereof has a protruding portion 26 for moving to and fro by a user. The receiving seat 2 is provided on one end thereof with a hook 21, and is provided on the other end thereof with a tenon 22; the receiving seat 2 is provided further on the two lateral walls thereof with a plurality of holes 23 to respectively receive therein a supporting rod 25 and the fixedly mounted positioning rod 24 which has its both ends extended out of the receiving seat 2. The receiving seat 2 can slide along the supporting rod 25 to allow the stop piece 1 to be assembled in the receiving seat 2 by means of the positioning rod 24.

Figure 2:
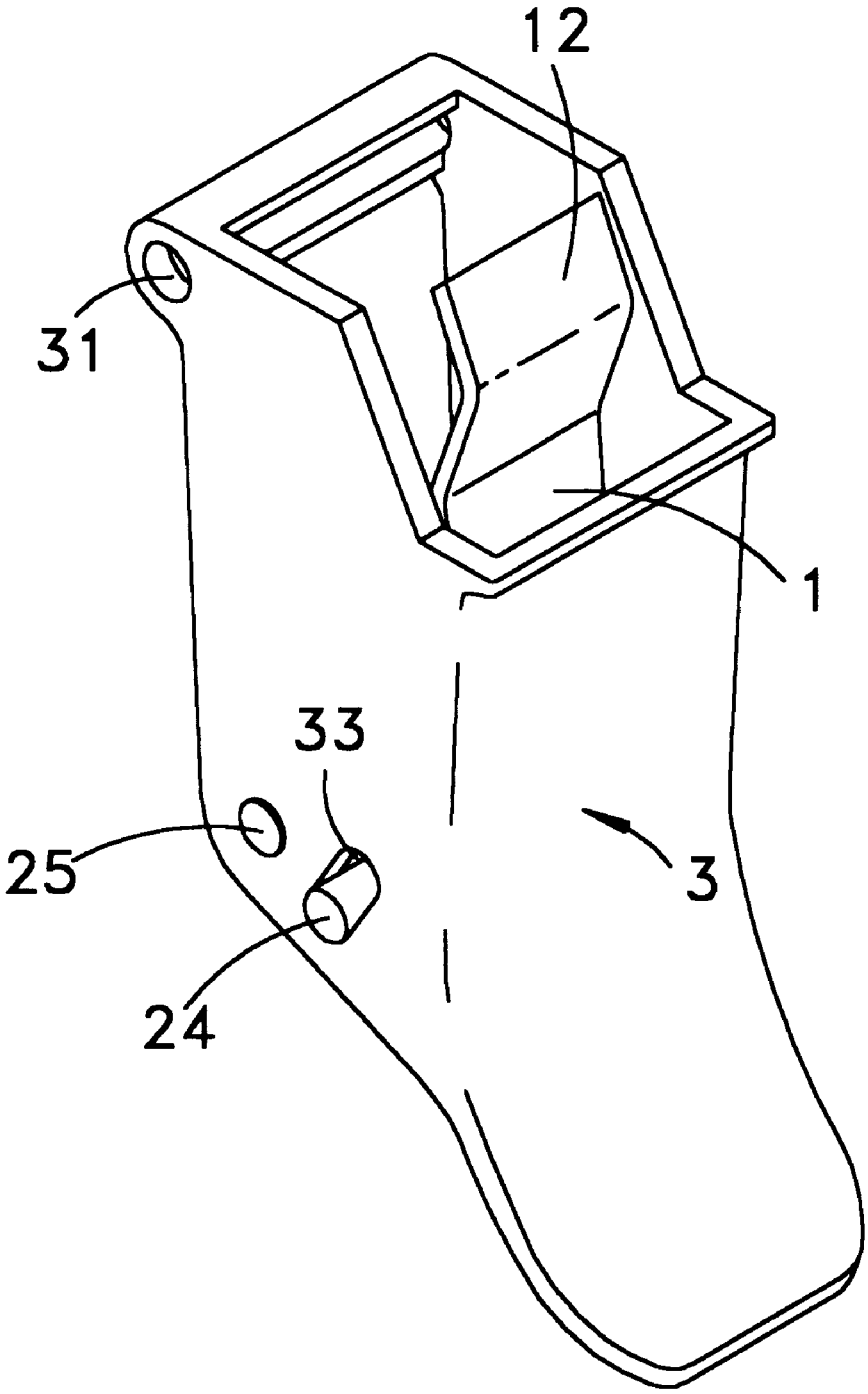
FIG. 2 is a perspective view of the present invention.

The trigger 3 is in the shape of "U" (referring to FIG. 3), one end thereof is provided with an assembling hole 31, so that the trigger 3 can sway to and fro and can be combined with the fastening tool 4, the trigger 3 is provided on both sides thereof with a rod hole 32; one side thereof is provided with a tenon hole 37, a tenon groove 36 and two positioning holes 34, 35, while the other side thereof is provided with an arciform slide hole 33 and a spring receiving hole 38 (referring to FIG. 2). The arciform slide hole 33 is aligned with both the positioning holes 34, 35, The tenon hole 37 and the tenon groove 36 both can receive therein the tenon 22 of the receiving seat 2. The positioning holes 34, 35 and the arciform slide hole 33 can receive respectively an end of the positioning rod 24 on the receiving seat 2 therebetween. The spring receiving hole 38 and the hook 21 of the receiving seat 2 can be mounted therebetween the spring 39, and the rod hole 32 can be inserted therein the supporting rod 25 to combine the receiving seat 2 with the trigger 3. The supporting rod 25 in the receiving seat 2 forms a fulcrum to allow the receiving seat 2 to sway and displace in the trigger 3, and to synchronically move the beveled stop end 12 for changing its position.

By combination of the receiving seat 2 with the stop piece 1 by means of the supporting rod 25 (referring to FIG. 2 and 3), the trigger 3 is combined with the receiving seat 2 by means of the supporting rod 25 and the positioning rod 24; so that the two ends of the positioning rod 24 are mounted respectively in the positioning hole 35 and the arciform slide hole 33. The two ends of the spring 39 are received respectively in the spring receiving hole 38 and the hook 21 of the receiving seat 2, so that the spring 39 is mounted straddling said trigger 3 and the receiving seat 2 and can pull the receiving seat 2 to allow it to slide and move elastically in the trigger 3, and to engage the tenon 22 of the receiving seat 2 in the tenon groove 36 of the trigger 3. And a supporting axle 43 of the fastening tool 4 is slipped over with the assembling hole 31 of the trigger 3, so that the trigger 3 can be pivotally mounted between a safety yoke 41 and a trigger valve 42 (referring to FIG. 1), and the supporting axle 43 forms a fulcrum for the trigger 3. Therefore, the trigger 3 can synchronically move the receiving seat 2 and the stop piece 1 to allow the stop piece 1 to be assembled between the safety yoke 41 and an axle 421 of the trigger valve 42 (referring to FIG. 4). The switching structure of the present invention thus is completed.

If the user does not abut the fastening tool 4 against the surface of a work piece, and thereby the safety yoke 41 is not pressed (referring to FIG. 4), the stop piece 1 in the trigger 3 can sway freely in the receiving seat 2; hence the trigger 3 can not move the axle 421 of the trigger valve 42, and the fastening tools 4 can neither shoot a fastener. Safety of the fastening tools 4 in use can thereby be assured.

Figure 5:
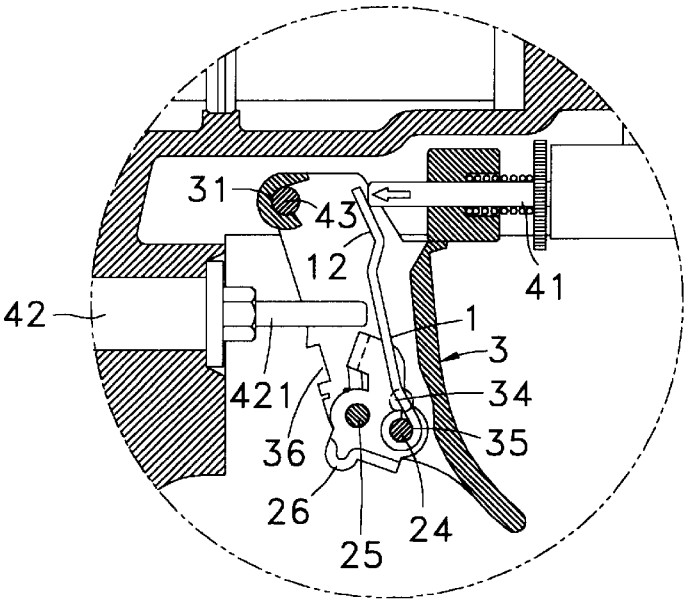
FIG. 5 is a sectional view showing the safety yoke of FIG. 4 is pressed.
Figure 6:
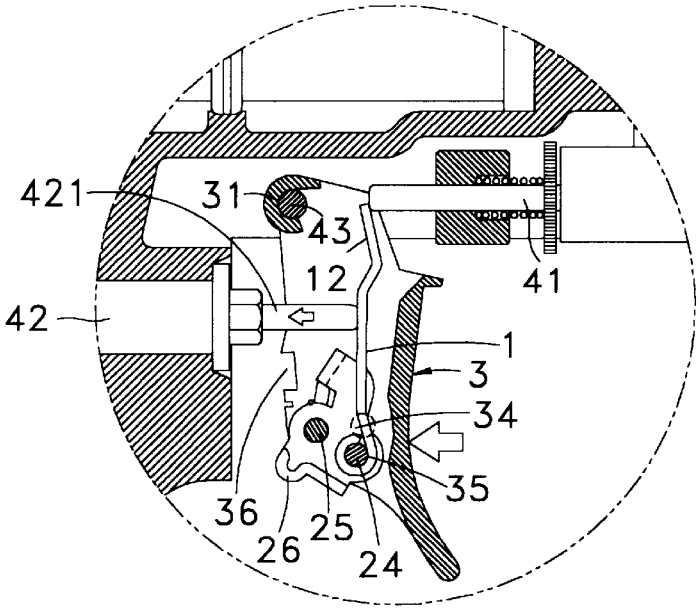
FIG. 6 is a sectional view showing the trigger of FIG. 5 is pressed.
Figure 7:
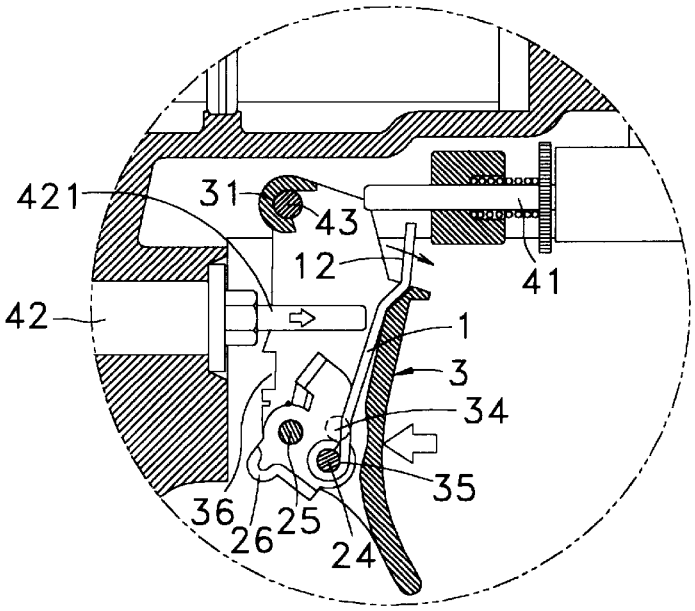
FIG. 7 is a sectional view showing the state after pressing the trigger as shown in FIG. 6.

When the user abuts the shooting outlet of the fastening tools 4 against the surface of a work piece, and then presses the safety yoke 41 (referring to FIG. 5), the beveled stop end 12 on the stop piece 1 in the trigger 3 will be pushed by the safety yoke 41. Now, only if the trigger 3 is pressed by the user, the receiving seat 2 and the stop piece 1 in the trigger 3 can sway toward the trigger valve 42 and thereby the stop piece 1 can press the axle 421 of the trigger valve 42, and the fastening tool 4 shoots a fastener immediately (referring to FIG. 6). Thereafter, the beveled stop end 12 on the stop piece 1 will be released from the pushing end of the safety yoke 41 under resilient moving-back force of the axle 421 of the trigger valve 42 (referring to FIG. 7). This separation of the stop piece 1 from the safety yoke 41 prevents the user from repeatedly pressing the axle 421 of the trigger valve 42 by pressing the trigger 3. In other words, the user must make the safety yoke 41 move back to its original position, and abut the safety yoke 41 against the surface of a work piece once more, then he can push the stop piece 1 to make another shot. This is the feature of the full sequential trigger.

When the user takes a contact actuation or full sequential actuation mode to use the fastening tools 4 for fastening, he can push the protruding portion 26 on the receiving seat 2 to make the tenon 22 and the positioning rod 24 of the receiving seat 2 leave the positioning holes 35 and the tenon groove 36 of the trigger 3. By guiding of the arciform slide hole 33 for the positioning rod 24, the receiving seat 2 synchronically moves the stop piece 1, and the tenon 22 and the positioning rod 24 of the receiving seat 2 are received respectively the tenon hole 37 and the positioning hole 34 by pulling force of the spring 39. Thereby, the beveled stop end 12 on the stop piece 1 is moved to get close to the safety yoke 41, and thereby change the contact area between the beveled stop end 12 on the stop piece 1 and the safety yoke 41 (referring to FIG. 8). And this changes the full sequential mode into the contact actuation mode.

Figure 9:
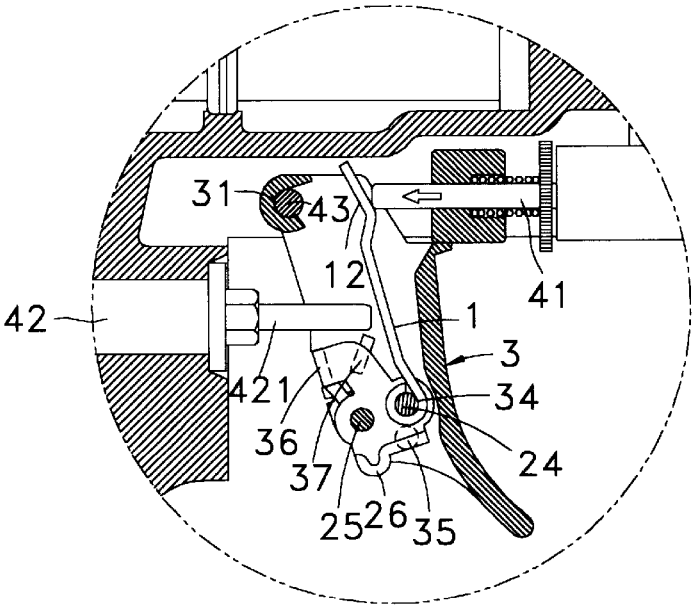
FIG. 9 is a sectional view showing the safety yoke of FIG. 8 is pressed.
Figure 10:
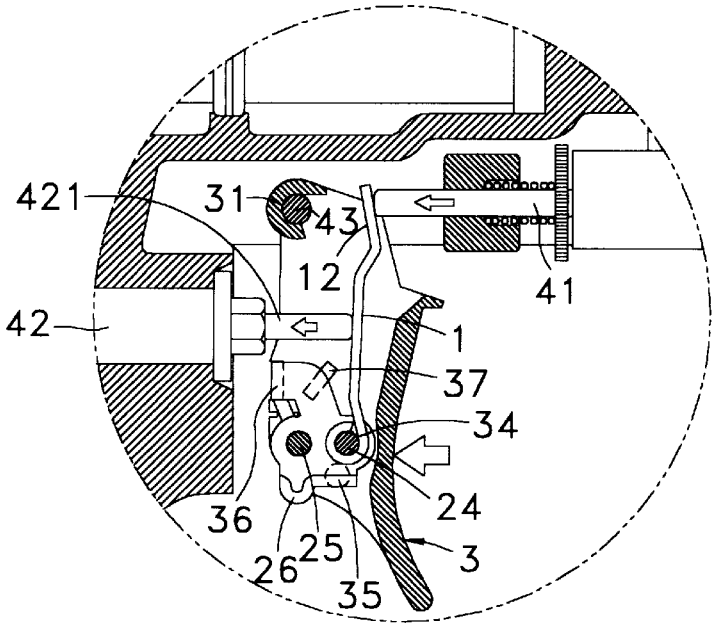
FIG. 10 is a sectional view showing the trigger of FIG. 9 is pressed.

When the user does not abut the shooting outlet of the fastening tools 4 against the surface of a work piece, and hence does not press the safety yoke 41 (referring to FIG. 8), the stop piece 1 in the trigger 3 can still freely sway in the receiving seat 2, but can not make the fastening tools 4 shoot a fastener. And when the user abuts the shooting outlet of the fastening tool 4 against the surface of a work piece and presses the safety yoke 41, then the safety yoke 41 can push the beveled stop end 12 to limit the stop piece 1 to the space between the safety yoke 41 and the receiving seat 2 in the trigger 3 (referring to FIG. 9). Therefore, when the user presses the trigger 3, the receiving seat 2 and the stop piece 1 are moved toward the axle 421 of the trigger valve 42, and in turn the stop piece 1 presses axle 421 of the trigger valve 42 (referring to FIG. 10) to make the fastening tools 4 shoot a fastener. At this time, the stop piece 1 still is limited to the space between the safety yoke 41 and the receiving seat 2 in the trigger 3. Hence when the user once more presses the trigger 3, the stop piece 1 still can be moved toward the axle 421 of the trigger valve 42 by the trigger 3 to make the fastening tools 4 shoot a fastener. Thereby, the contact actuation shooting action of the trigger 3 can be effected.

Figure 11:
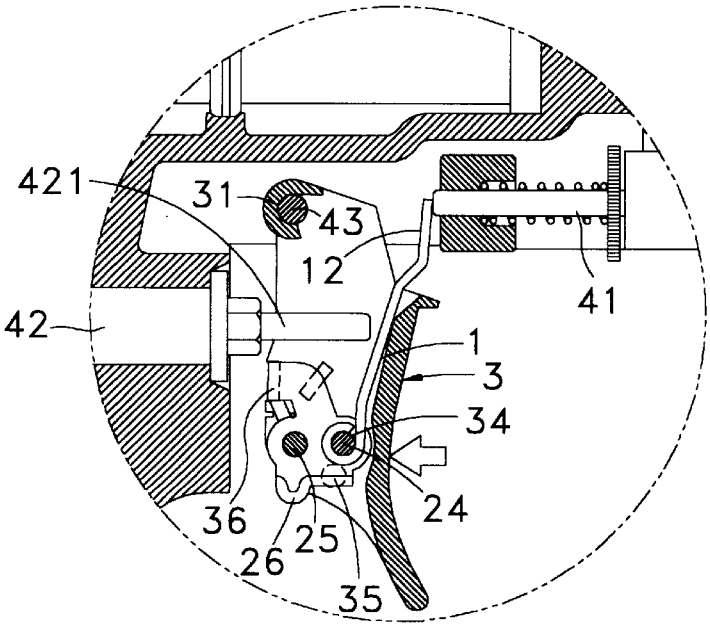
FIG. 11 is a sectional view showing the trigger in FIG. 8 is pressed.

Further, if the user only presses the trigger 3 but does not abut the safety yoke 41 against the surface of a work piece for contact actuation (referring to FIG. 11), the stop piece 1 is not moved by the safety yoke 41, thereby the fastening tool 4 can not shoot a fastener. This forms a safety guard function in the contact actuation shooting operation.

Figure 4:
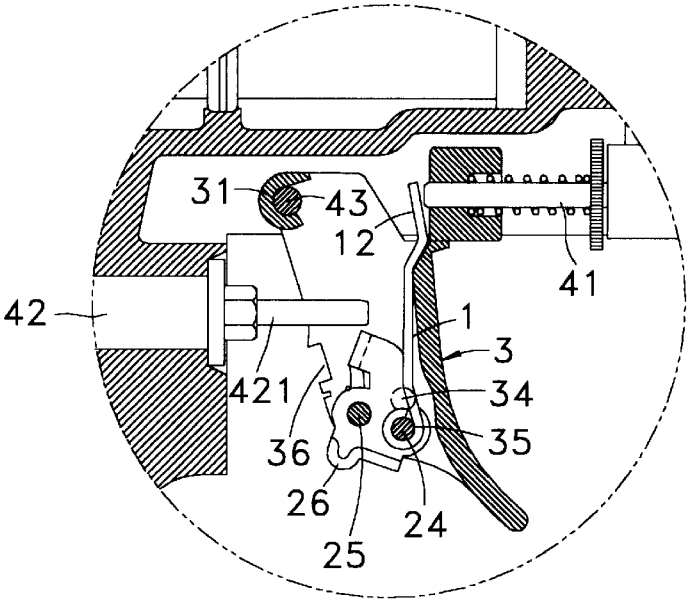
FIG. 4 is a sectional view showing position of a stop piece of the present invention when in contact fastening mode.
Figure 8:
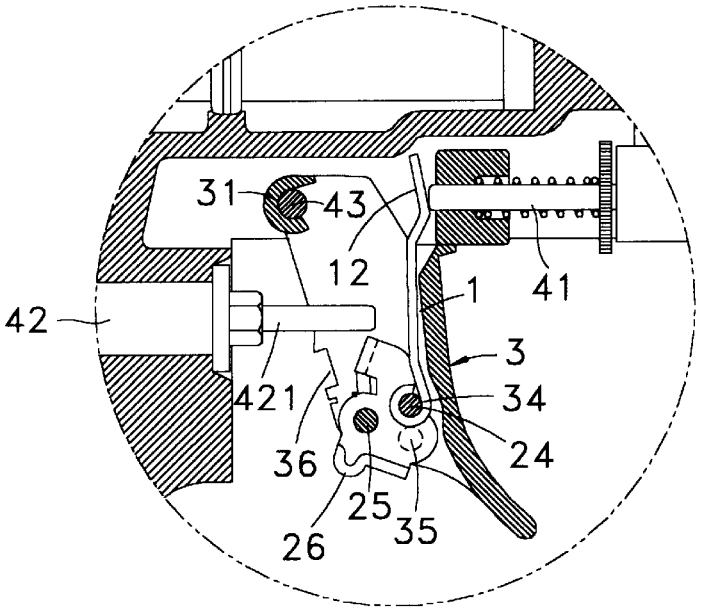
FIG. 8 is a sectional view showing position of the stop piece of the present invention when in full actuation fastening mode.

When the user desires to take a full sequential fastening mode of the fastening tools 4 again, he can push the protruding portion 26 on the receiving seat 2 again to recover the full sequential fastening mode of the switching structure (as shown in FIG. 4), and he can once more change into the contact actuation mode (as shown in FIG. 8). Therefore, free switching effect can be provided.

The embodiments cited above are only for illustrating the present invention, and not for giving any limitation to the scope of the present invention. It will be apparent to those skilled in this art that various modifications or changes can be made to the elements of the present invention without departing from the spirit, scope and characteristic of this invention. Accordingly, all such modifications and changes also fall within the scope of the appended claims and are intended to form part of this invention.

What is claimed is:

1. A trigger switching structure of a contact/full sequential actuation fastening tool, being used in a trigger in the shape of "U" and pivotally mounted between a safety yoke and a trigger valve both of said fastening tool, said switching structure is comprised of a receiving seat, a stop piece and a spring, and is characterized by that:

said stop piece has a pivot end and a beveled stop end, said pivot end is inserted therethrough with a positioning rod for pivotally mounting said stop piece on said receiving seat;

said receiving seat is in the shape of "U" and is provided on one end thereof with a tenon, said positioning rod is fixedly provided on said receiving seat and has its both ends extended out of said receiving seat;

a supporting rod is fixed on said trigger and is inserted in said receiving seat, said spring is mounted straddling said trigger and said receiving seat to allow said receiving seat to slide and move elastically in said trigger;

said trigger is provided on one side thereof with a tenon hole, a tenon groove and two positioning holes, said tenon hole and tenon groove both are adapted to receiving therein said tenon of said receiving seat; said trigger is provided on the other side thereof with an arciform slide hole aligned with both said positioning holes;

by combination of the above members, and by assembling said stop piece between said safety yoke and said axle of said trigger valve, the two ends of said positioning rod is adapted to switching in said arciform slide hole and between said two positioning holes, a user can thus conveniently adjust said receiving seat to allow said tenon to switch elastically to change the engaging position of said tenon hole and tenon groove, thereby, said stop piece is moved and its position relative to said safety yoke and said axle of said trigger valve is changed over between a contact and a full sequential actuation position for fastening.

2. A trigger switching structure of a contact/full sequential actuation fastening tool as claimed in claim 1, wherein, said receiving seat is provided on one end thereof with a hook, while said trigger is provided on one side thereof with a spring receiving hole, hence said spring receiving hole and said hook can be mounted therebetween said spring.

3. A trigger switching structure of a contact/full sequential actuation fastening tool as claimed in claim 1, wherein, said stop piece is bent to form a beveled surface to contact with and separate from said safety yoke under control, thus said stop piece also presses and separates from said axle of said trigger valve under control.

4. A trigger switching structure of a contact/full sequential actuation fastening tool as claimed in claim 1, wherein, said receiving seat is provided on the bottom thereof with a protruding portion for being moved.

* * * * *